US005769230A

United States Patent [19]

Koefelda

[11] Patent Number: 5,769,230

[45] Date of Patent: Jun. 23, 1998

[54] STACKABLE AND NESTABLE CASE WITH HINGED COVER

[75] Inventor: Gerald R. Koefelda, Hermosa Beach, Calif.

[73] Assignee: Rehrig-Pacific Company, Inc., Los Angeles, Calif.

[21] Appl. No.: 678,708

[22] Filed: Jul. 11, 1996

[51] Int. Cl.[6] ..... B65D 21/036

[52] U.S. Cl. ..... 206/508; 206/518; 220/509; 220/516; 220/23.6

[58] Field of Search ..... 206/505, 508, 206/518, 503, 507, 515; 220/23.6, 23.83, 23.86, 507, 509, 515, 516, 521, 522, 523, 555

[56] References Cited

U.S. PATENT DOCUMENTS

| | | | |
|---|---|---|---|
| 3,752,385 | 8/1973 | Woodgate . | |
| 4,161,261 | 7/1979 | Frater | 206/508 |
| 4,256,224 | 3/1981 | Hirota | 206/505 |
| 4,349,121 | 9/1982 | Lafferty . | |
| 4,410,099 | 10/1983 | de Larosiere . | |
| 4,823,955 | 4/1989 | Apps . | |
| 4,899,874 | 2/1990 | Apps et al. . | |
| 5,009,053 | 4/1991 | Langenbeck et al. . | |
| 5,031,774 | 7/1991 | Morris et al. . | |
| 5,267,649 | 12/1993 | Apps et al. | 206/505 |
| 5,277,316 | 1/1994 | Apps et al. . | |
| 5,555,996 | 9/1996 | Lang-Ree et al. | 206/505 |

FOREIGN PATENT DOCUMENTS

| | | | |
|---|---|---|---|
| 2108933 | 5/1983 | United Kingdom | 206/508 |
| 93018975 | 9/1996 | WIPO | 206/505 |

*Primary Examiner*—Stephen J. Castellano
*Attorney, Agent, or Firm*—Banner & Witcoff, Ltd.

[57] ABSTRACT

A stackable and nestable full-depth case for bottles having a floor structure for supporting a plurality of bottles thereon, a plurality of vertical columns extending upwards from the floor structure, a rim connecting the plurality of columns, and a bifurcated cover hingedly connected to an upper edge of the rim and positionable in open and closed positions over the bottles. The bifurcated cover includes a ceiling and a plurality of separating projections depending from an under surface of the ceiling. The separating projections engage the bottles when the cover is in the closed position thereover such that the bottles are retained in an upright position. Each separating projection is generally semi-cylindrical in shape and surrounds at least a portion of the top of each bottle. In a preferred embodiment, each separating projection includes an inner semi-cylindrical wall, an outer semi-cylindrical wall, and a sloping, semi-circular collar element connected therebetween. The collar element engages a neck of the bottle when the cover is in the closed position and thereby distributes the weight of an upper stacked case to the shoulder portions of the bottles therebelow.

11 Claims, 5 Drawing Sheets

STACKABLE AND NESTABLE CASE WITH HINGED COVER

BACKGROUND OF THE INVENTION

The present invention relates to a stackable and nestable full-depth case for transporting and storing beverage containers, such as two liter bottles and the like, and in particular, to a case for bottles having a hinged cover adapted specifically therefor.

Bottles for soft drinks and other beverages are often stored and transported during the distributing stages thereof in short-walled cardboard trays or in cardboard boxes wherein the fold in the cardboard along the edge of the case serves as a hinge. Cases of this type are subject to rapid deterioration due to the repeated bending of the cardboard hinge. These cardboard structures are generally not rugged enough for reuse and therefore must be broken down and discarded by the retailer at his expense. This creates a costly and labor intensive process for the retailer and also contributes to the problem of environmental waste. In addition, paperboard cartons are flimsy and can collapse when wet. They are also unattractive and generally do not permit the full displaying, merchandising and advertising of the bottled beverage.

An example of a prior art cardboard case is disclosed in U.S. Pat. No. 3,752,385 to Woodgate. This case additionally provides a plastic divider which, when placed in the cardboard case, forms separate bottle receiving compartments. The plastic divider, however, does not overcome the aforementioned disadvantages generally associated with paperboard boxes. Thus, there has been a need for a returnable and reusable case for storing and transporting bottles and the like. The case should be light weight, easy to manipulate and carry, and economically constructed, since the non-reusable cardboard boxes which it replaces generally has very low associated costs.

Reusable plastic cases have been developed for transporting and storing bottles such as two-liter beverage bottles. An example of a recent plastic, nesting and stacking storage container is that disclosed in U.S. Pat. No. 4,823,955 of the present assignee. These cases often have a height which is greater than the height of the bottles contained therein such that when stacked the cases do not rest on top of the bottles in the lower case. Rather, the sides of the cases bear the load of the upper cases and their contents. These cases generally do not have covers. They are also expensive to manufacture, and to ship and store when empty as they are relatively large and occupy a large amount of space.

In response to the demand for a more conveniently sized case, plastic low depth trays have been developed wherein the side walls are lower than the height of the stored bottles. The bottles contained in a lower tray thereby support the weight of the other trays stacked on top of them, and this is particularly well suited for today's plastic, polyethylene terephthalate (PET) bottles. One commercially successful design of the stackable low depth tray particularly suitable for two-liter PET bottles is the Castle Crate® design of the present assignee, such as is disclosed in U.S. Pat. No. 4,899,874. In the Castle Crate® case, the PET bottles are stacked such that the container closures or bottle tops support the weight of the loaded case above. Thus, even though they are flexible, their walls are sufficiently strong to safely support a loaded case thereabove and contain the pressure of the carbonated beverages in the bottles. In fact, the carbonation of the beverages provides the strength to the walls of the bottles that allows their flexible walls to bear these surprisingly high compressive loads, as long as these loads are applied axially. Thus, it is important that the bottles do not tip in these trays, as the loads thereon when stacked would then not be along the longitudinal axes of the bottles, and the loaded bottles would thereby be caused to buckle. This case design is not particularly well-suited for use with returnable and/or refillable PET bottles, however, because of the risk of damaging or scratching the top closure areas of the bottles during their return. Bottles may not always be returned with the bottle cap secured thereon. Thus, when an upper case is stacked directly on the exposed top closure area of the bottle, there may be scratching that will affect the ability of the bottle to be resealed with a cap.

Beverage cans or bottles are often sold, as in convenience stores, loose or individually, that is, not in an attached six-pack arrangement. To meet the demand of being able to easily remove individual containers from a case, trays for beverage cans have been developed such as those disclosed in U.S. Pat. No. 5,031,774 to Morris et al., U.S. Pat. No. 5,009,053 to Langenbeck et al., and low-depth can trays of the present assignee, as disclosed in U.S. Pat. No. 5,277,316. This tray allows substantial visibility of the cans supported therein while also allowing a single can to be easily removed therefrom. Beverages in twelve or sixteen ounce bottle sizes may also be sold loose or individually. However, to remove the bottles from their six-pack (secondary) packaging, whether a shrink wrap or a cardboard enveloping carton, is a labor intensive procedure which also produces additional waste for disposal. It is desirable, therefore, to provide a bottle case from which individual bottles may be easily removed and which is reusable.

Thus, there is a strong need for a reusable and returnable case for bottles which retains the bottles in an upright position and redistributes the weight of the stacked cases away from the top of the bottle, thereby reducing the incidence of closure damage, which holds and separates the bottles to prevent contact between adjacent bottles and with the case, allows for the easy removal of individual bottles, is light weight and easy to handle, and is economical to manufacture.

SUMMARY OF THE INVENTION

Accordingly, it is a principal object of the present invention to provide an improved stackable and nestable case for storing and transporting containers, such as beverage bottles. Although it may be used for any bottles, the present invention is particularly suited for returnable PET bottles which cannot use conventional low depth crates because of the possibility of bottle top damage when returned empty.

A further object of the present invention is to provide an improved stackable and nestable full-depth bottle case including a floor structure which has a plurality of separated bottle areas to hold loose bottles therein in a compact array while preventing them from rubbing against one another during transport and a hinged cover which engages the tops of these bottles to thereby maintain them in the spaced, upright position and prevent closure damage when a loaded bottle case is stacked on a case of empty bottles therebelow.

A still further object of the present invention is to provide a plastic, stackable and nestable case which is light weight, economical to manufacture and attractive.

Directed to achieving these objects, a novel stackable and nestable case for beverage containers is herein provided with a hinged cover. The case is formed by integrally molding from plastic a floor structure for supporting a plurality of bottles thereon, a plurality of vertical columns extending upwards from the floor structure, and an upper rim connecting the plurality of columns. A cover is hingedly connected to the upper rim and is positionable in open and closed positions. The cover includes a ceiling and a plurality of separating projections depending from an under surface of the ceiling. The separating projections engage the bottles when the cover is in the closed position thereover such that the bottles are retained in an upright position and the closure area of the bottle is protected from possible damage or scratching. Each separating projection is generally semi-cylindrical in shape and surrounds at least a portion of the top closure of each bottle. In a preferred embodiment, each separating projection includes an inner semi-cylindrical wall, an outer semi-cylindrical wall, and a sloping, semi-circular collar element connected therebetween. The collar element engages the bottle when the cover is in the closed position and thereby distributes the weight of an upper stacked case to the shoulder portions of the bottles therebelow, rather than resting the weight of the upper case entirely upon the bottle tops. The case can also be nested within another similar case when empty for more efficiently using space during transport and storage.

Other objects and advantages of the present invention will become more apparent to those persons having ordinary skill in the art to which the present invention pertains from the following description taken in conjunction with the accompanying drawings.

DETAILED DESCRIPTION OF THE PREFERRED EMBODIMENTS

Figure 1:
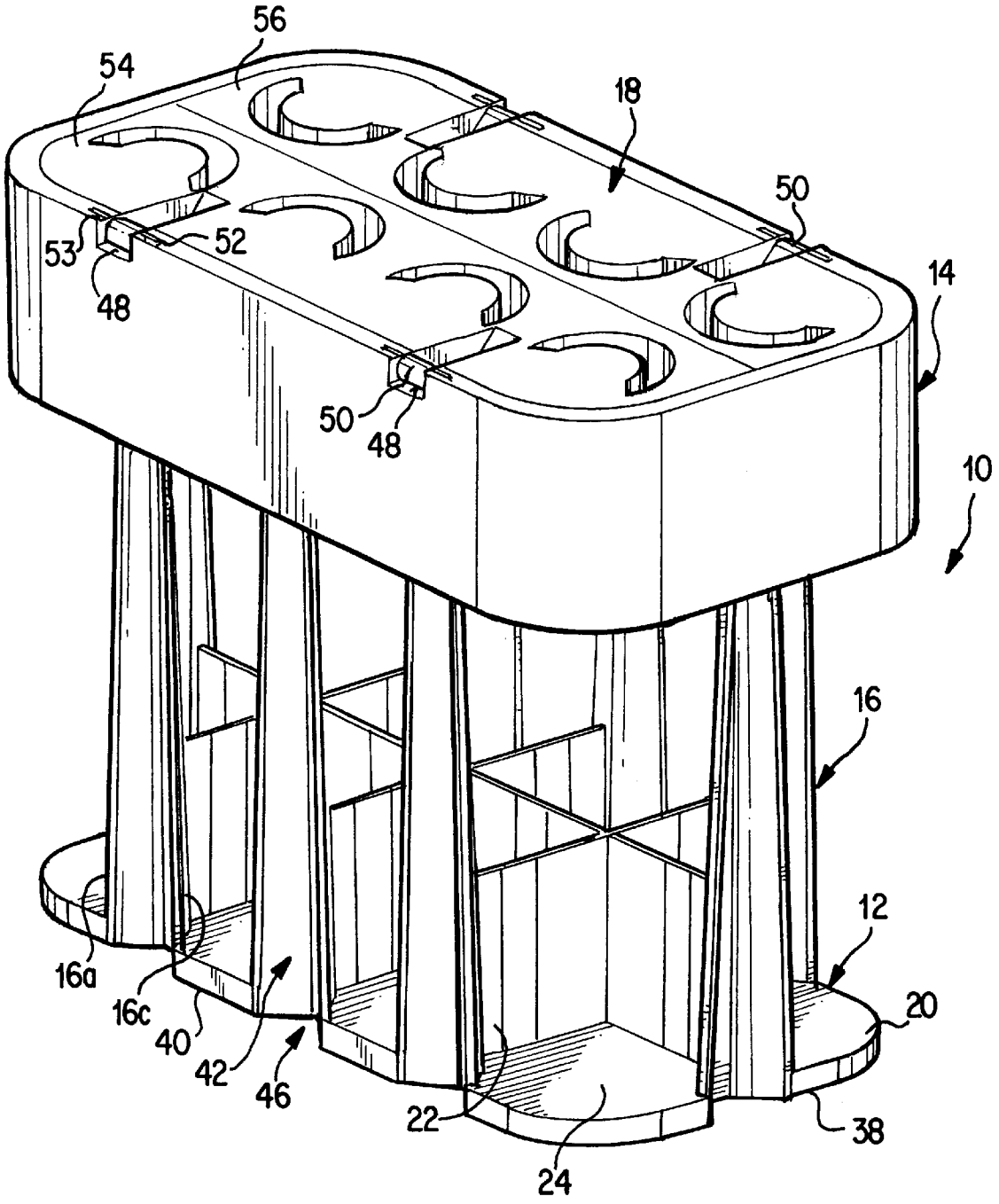
FIG. 1 is a perspective view showing a case with a hinged cover in the closed position according to a preferred embodiment of the present invention.
Figure 2:
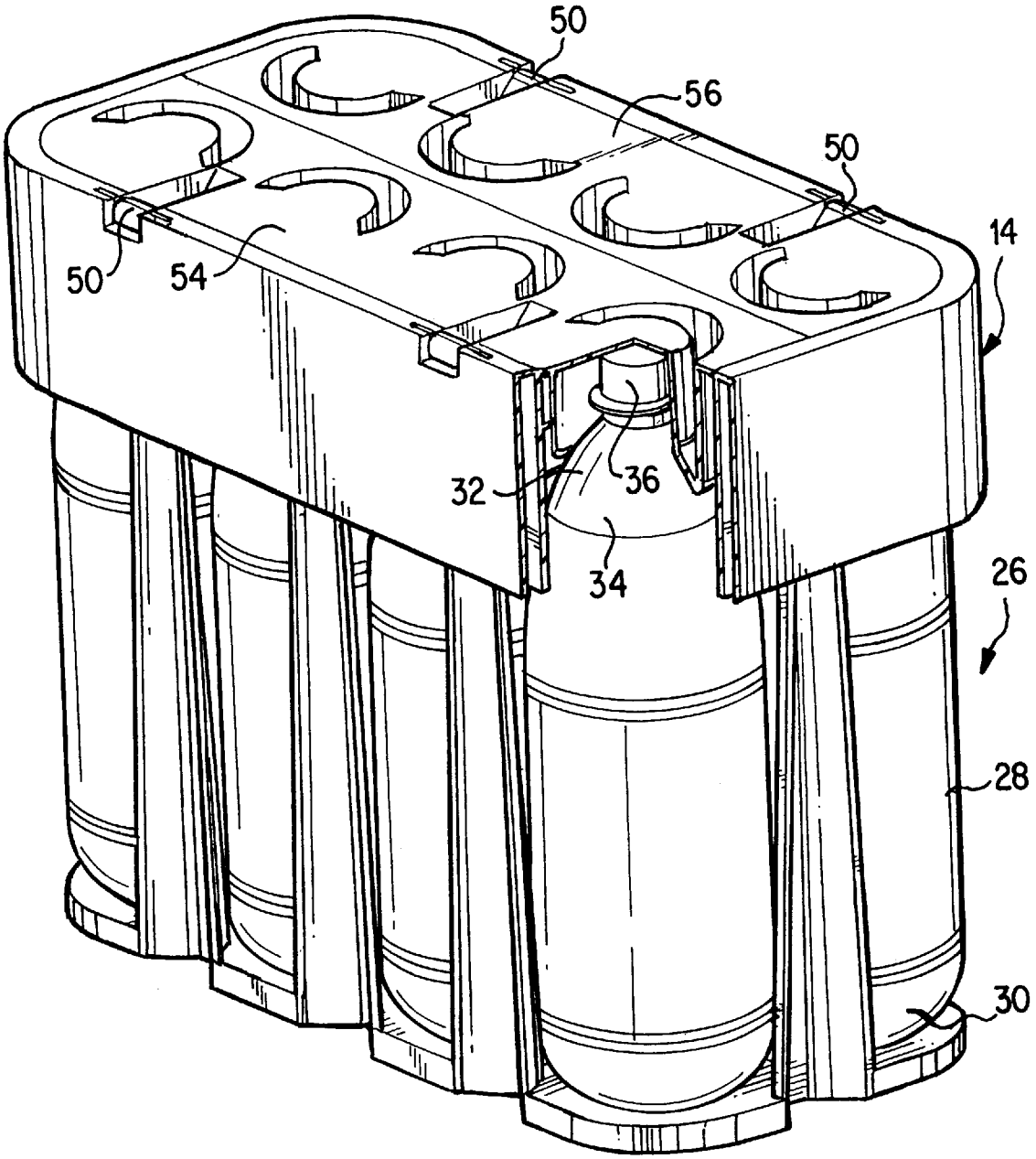
FIG. 2 is a perspective view of the case shown in FIG. 1 when loaded with bottles, a portion thereof being broken away for clarity.

The present invention, as will be explained, can be adapted to hold generally any type of fluid containers and is especially adaptable for one or two liter PET bottles, such as those commonly used today in the soft drink industry. In particular, the present invention is designed for returnable/refillable PET bottles because of its ability to protect the bottle closure area from damage when being returned.

A preferred embodiment of a full-depth case in accordance with the present invention is shown in FIGS. 1–5 generally at 10. Case 10 is integrally molded from a plastic, such as a high density polyethylene which is a standard container material, in a sturdy, lightweight construction. Case 10 comprises four basic components, namely, a floor structure 12, an upper rim 14, a plurality of vertical columns 16 extending between floor structure 12 and upper rim 14, and a cover 18 hingedly connected to upper rim 14. Floor structure 12 includes a generally planar floor 20 and a plurality of dividing walls 22 for defining a plurality of bottle support areas 24 for supporting thereon bottles 26. Bottles 26 are preferably two liter PET bottles, but it should be obvious to one skilled in the art that bottles of any size can be utilized. Bottles 26 include a generally cylindrical body 28 having a first diameter, a bottom member 30 attached or integrally formed with the bottom of cylindrical body 28 to thereby form a container, a tapered neck portion 32, a curved shoulder portion 34 connecting body 28 to neck portion 32, and a circular top threaded portion (not shown) having a second smaller diameter. A removable bottle top 36 is disposed over the top threaded portion to sealingly protect the bottle contents from the external environment until the desired consumption time. Top 36 may be removed, for example, by either applying a twisting force in the counter-clockwise direction or with the assistance of a bottle opener.

Floor 20 has opposing end portions or ends 38 and opposing side portions or sides 40 which define the outer periphery of floor structure 12. Vertical columns 16 are disposed on opposing sides and ends of floor 20 and dividing walls 22 extend therebetween to define bottle support areas 24. Each vertical column 16 is approximately the height of the bottles to be retained and includes three tapering segments 16*a,* 16*b,* 16*c* which form a generally triangular shaped column 16 having an open back surface 42 and a truncated front surface 44 joining with dividing wall 22 on the lower portion thereof. Dividing walls 22 have a lesser height than columns 16, approximately one-third the height thereof in the preferred embodiment. The angled segments 16*a,* 16*b,* 16*c* of columns 16 provide a bottle support area more conforming to the configuration of bottles 26 than the rectangular pockets known in the prior art. The open triangular base of columns 16 joins a corresponding indentation 46 of floor structure 12 such that the outer periphery of floor structure is generally rectangular with rounded comers and a plurality of triangular indentations 46 spaced therealong.

Figure 4:
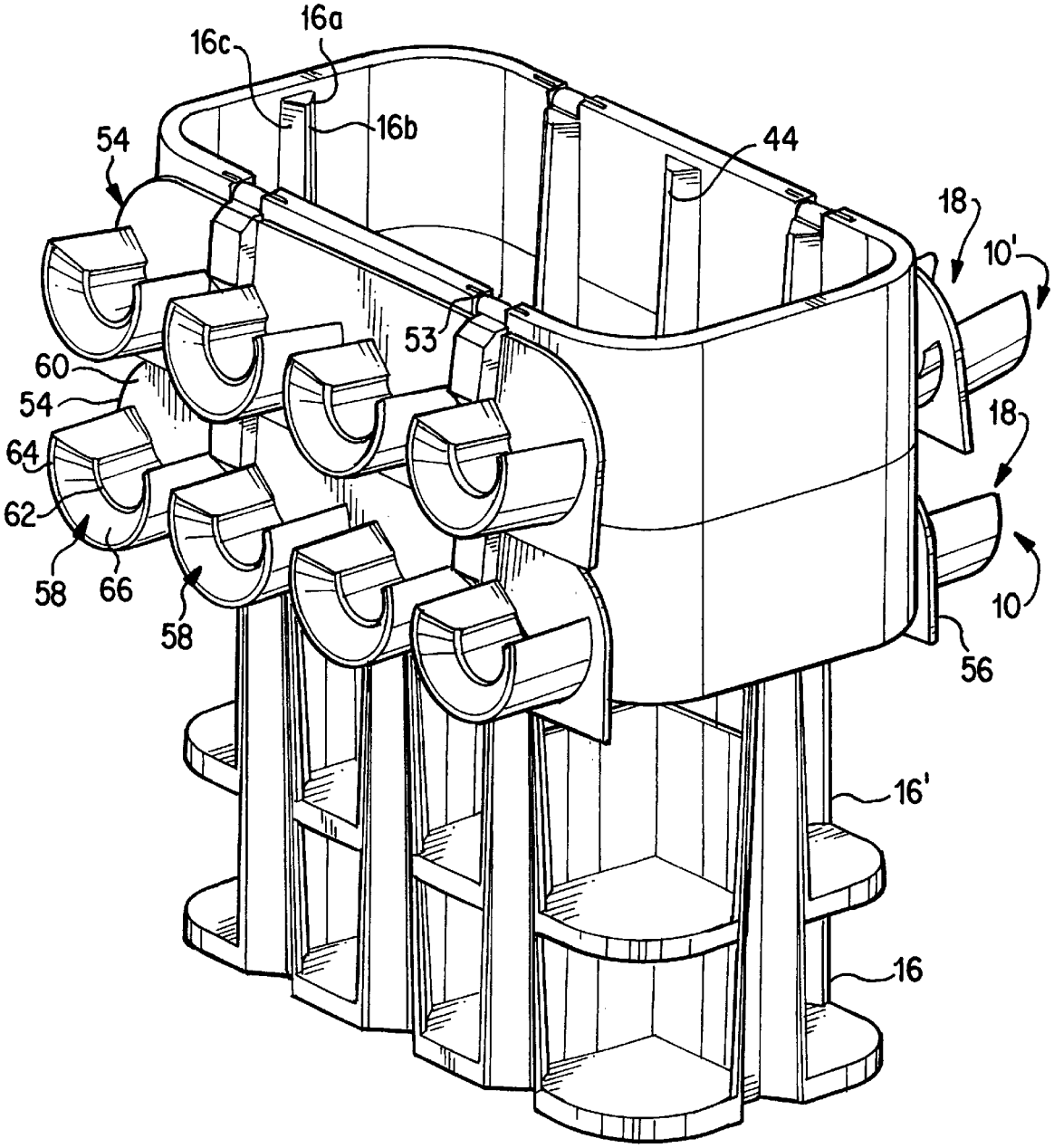
FIG. 4 is a perspective view of nested cases of the present invention.

Surrounding and connecting the upper portions of vertical columns 16 is upper rim 14. Rim 14 is generally rectangular in shape with rounded corners and has a height of approximately equal to the nesting height or one-third the bottle height in the preferred embodiment. Thus, the majority of bottle 26 below rim 14 is exposed and easily viewed for display purposes. The upper edge of rim 14 includes a plurality of slots 48 for receiving hinge 50 and hinge pintles 52 of cover 18. As most clearly shown in FIGS. 1 and 4, cover 18 is bifurcated to form a first cover portion 54 and a second cover portion 56 that are hingedly connected on opposing sides of upper rim 14. Each hinge 50 is received in a respective slot 48 on upper rim 14 and a hinge pintle 52 extends through hinge 50 and engages respective pintle receiving spots 53 within rim 14. Cover 18 thereby pivots about hinge pintle 52 to either an open position as shown in FIG. 4 or a closed position as shown in FIG. 1.

Figure 5:
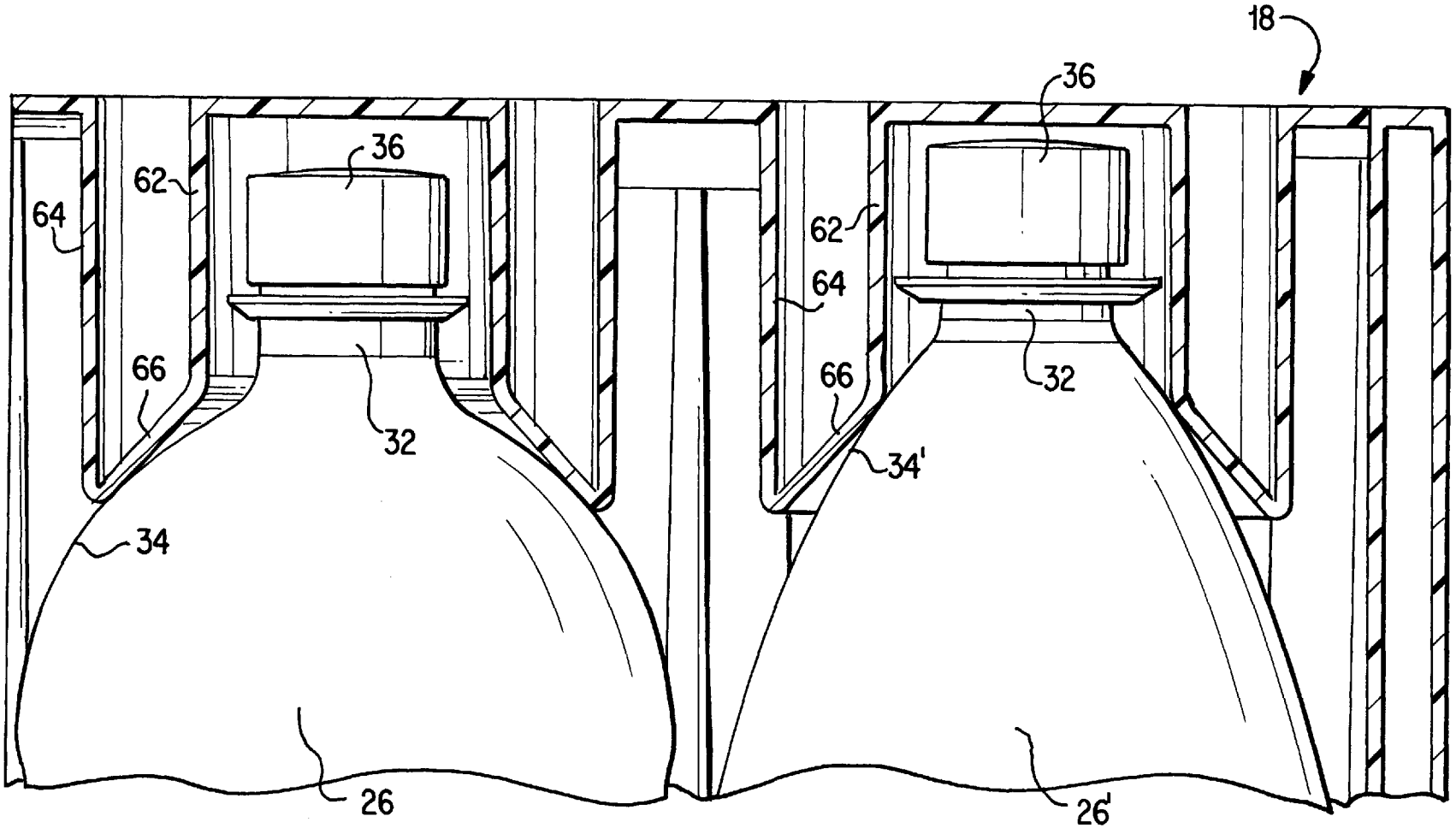
FIG. 5 is an enlarged sectional schematic illustrating the position of the cover over the tops of the bottles.

Cover 18 includes a plurality of separating projections 58 projecting downwards from the under surface 60 of cover 18. Separating projections 58 partially surround and receive therein the neck portion of bottles 26 and bottle tops 36 such that further movement of tops 36 is thereby halted. In combination with dividing walls 22, separating projections 58 maintain bottles 26 in an upright and spaced position so as to prevent adjacent bottles 26 from contacting one another. Referring also to FIG. 5, each separating projection includes an inner semi-cylindrical wall 62 and an outer semi-cylindrical wall 64 which partially surround neck potion 32 of bottle 26. In a preferred embodiment, a collar element 66 extends between and connects inner and outer semi-cylindrical walls 62, 64 to form a sloping semi-circular surface, since outer semi-cylindrical wall 64 has a greater height and extends further from under surface 60 of cover 18 than inner semi-cylindrical wall 62.

Figure 3:
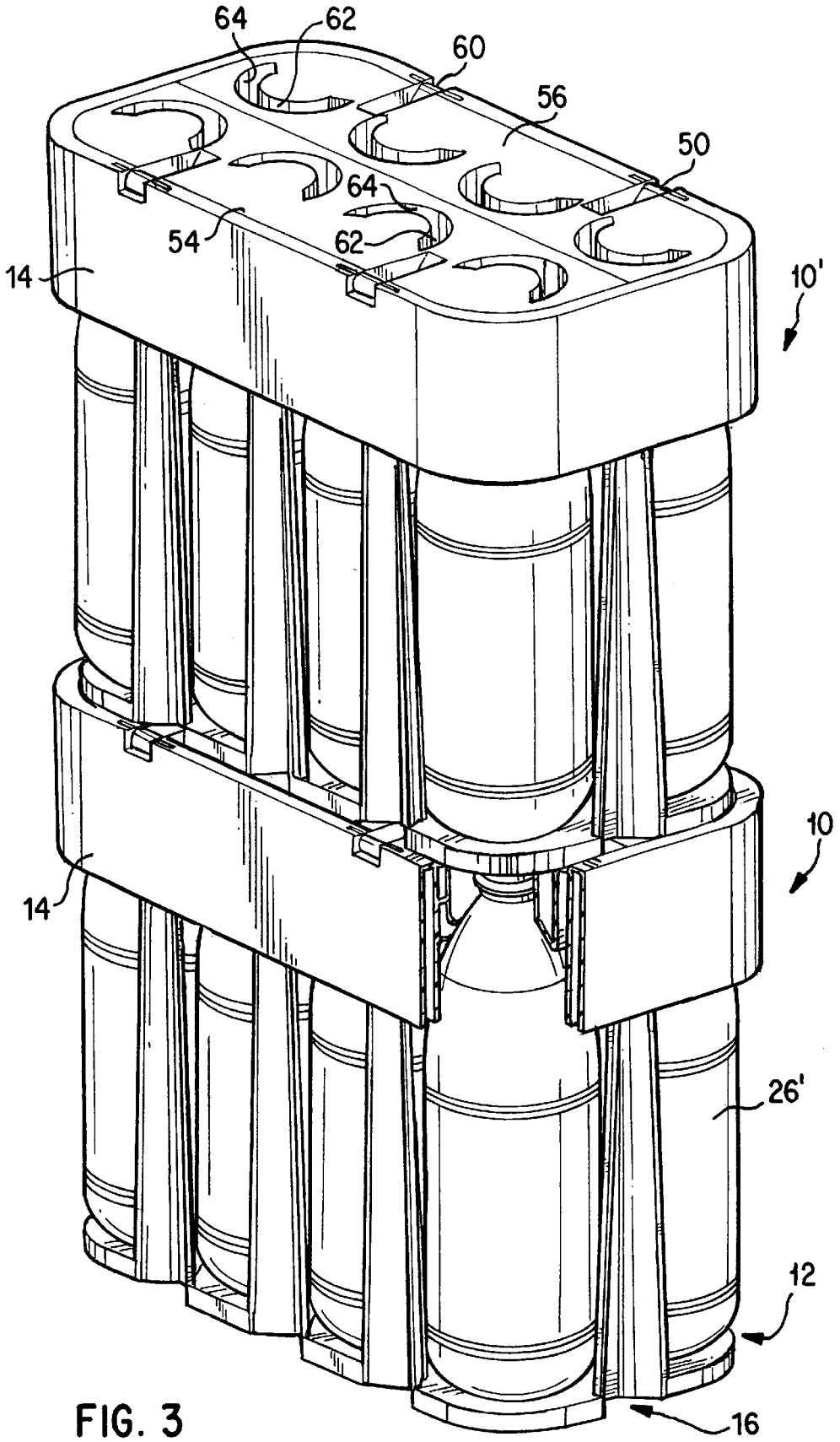
FIG. 3 is a perspective view of stacked and loaded cases of the present invention, a portion of the lower case being broken away for clarity.

When an identical case 10' is stacked upon case 10 with cover 18 in the closed position, as shown in FIG. 3, the weight of case 10' and the bottles therein is partially distributed by separating projections 58 to shoulder portions 34 of the bottles 26 therebelow rather than resting entirely upon tops 36. Thus, the force exerted on tops 36 is lessened and the chances of damage to tops 36 is reduced. Collar element 66 assists in evenly applying this force to the shoulder portion of the bottle, however, inner and outer semi-cylindrical walls 62, 64 alone can also accomplish this result. As illustrated in FIG. 5, cover 18 also may be utilized with various shaped bottles 26, 26', having either rounded shoulders 34 or more tapered shoulders 34'. In both instances, the weight of an upper loaded case is distributed to the shoulders of the bottles in the subjacent case rather than to the top closures.

A further advantage of the hinged cover of the present invention is that upper stacked and loaded case 10' may be easily removed from lower case 10 merely by pulling and slightly tilting or rotating upper case 10'. Since the tops of the bottles within lower case 10 are maintained in an upright position by the cover of case 10, the top surface of case 10 is interlocked with the bottom surface of case 10' through the conventional use of a slight recessed area in the bottom surface of case 10' and a corresponding protrusion in the top surface of case 10. Preferably, these aligning recessed areas and protrusions will correspond to the location of the bottle closures. Thus, in contrast to prior art low-depth cases for bottles, it is not necessary to lift an upper stacked case off from the bottle tops of the case therebelow. This feature reduces the time of the unloading and loading process and is also less strenuous for the delivery personnel.

As discussed briefly above, in the preferred embodiment of the invention columns 16 taper upwards. As a result, the uppermost portion of column 16 is smaller than that of the lowermost portion where column 16 joins floor 20. As illustrated in FIG. 4, this provides an ideal nesting arrangement. That is, when covers 18, 18' are in an open position, columns 16' of an upper case 10' are situated within columns 16 of case 10 when a plurality of similar cases are nested for transporting or storing. Upper case 10' rests upon dividing walls 22 of lower case 10 and further nesting is prevented by upper rim 14. A minimal amount of space is therefore needed and the cover stays attached to the case for future use.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. A stackable and nestable full-depth case for bottles, comprising:

a floor structure for supporting a plurality of bottles thereon and defining an outer peripheral surface;

a plurality of vertical columns extending upwards from said floor structure;

a rim having an upper edge and a lower edge, said rim connecting said plurality of columns;

a bifurcated cover hingedly connected to said upper edge of said rim and positionable in open and closed positions over the bottles, said bifurcated cover includes a generally planar ceiling structure and a plurality of separating projections depending from a lower surface of said ceiling structure, each said separating projection is adapted to engage one of the bottles when said cover is in the closed position over the bottles such that the bottles are retained in an upright position.

2. The stackable and nestable case of claim 1 wherein said bifurcated cover includes a first portion and a second portion, said first and second portions being hingedly connected to opposing sides of said rim.

3. The stackable and nestable case of claim 1 wherein each said separating projection is generally semi-cylindrical in shape and adapted to surround at least a portion of the top of each bottle.

4. The stackable and nestable case of claim 3 wherein each said separating projection includes an inner semi-cylindrical wall and an outer semi-cylindrical wall, a lower end of said outer wall depending further from said lower surface of said ceiling structure than a lower end of said inner wall.

5. The stackable and nestable case of claim 4 wherein said lower ends of said semi-cylindrical walls are adapted to engage a neck of the bottle when said cover is in the closed position.

6. The stackable and nestable case of claim 4 wherein said inner wall and said outer wall are connected at said lower ends thereof by a sloping, semi-circular collar element, said collar element is adapted to engage a neck of the bottle when said cover is in the closed position.

7. The stackable and nestable case of claim 3 wherein each said separating projection is capable of engaging a plurality of bottle shapes.

8. The stackable and nestable case of claim 1 wherein said floor structure includes a bottom generally planar floor and a plurality of dividing walls extending upwards from said floor such that a plurality of bottle support areas are thereby defined.

9. The stackable and nestable case of claim 8 wherein said plurality of vertical columns are taller than said plurality of dividing walls.

10. The stackable and nestable case of claim 8 wherein said plurality of vertical columns include a plurality of side columns and at least two end column positioned about said outer peripheral surface of said floor structure.

11. The stackable and nestable case of claim 8 wherein said plurality of dividing walls extend between opposing said side columns and opposing said end columns.

* * * * *